United States Patent [19]

Lenk et al.

[11] 4,429,838

[45] Feb. 7, 1984

[54] CLAMPING CHUCK IN WINDING MACHINES

[75] Inventors: Erich Lenk; Hansjochen Busch, both of Remscheid, Fed. Rep. of Germany

[73] Assignee: Barmag Barmer Maschinenfabrik AG, Remscheid-Lennep, Fed. Rep. of Germany

[21] Appl. No.: 311,749

[22] Filed: Oct. 15, 1981

[30] Foreign Application Priority Data

Oct. 16, 1980 [DE] Fed. Rep. of Germany ..... 3039064
Nov. 27, 1980 [DE] Fed. Rep. of Germany ..... 3044707

[51] Int. Cl.[3] ..... B65H 54/54
[52] U.S. Cl. ..... 242/46.4
[58] Field of Search ..... 242/46.4, 46.2, 46.3, 242/46.5, 46.6, 72 R, 72.1, 68.2, 18 DD

[56] References Cited

U.S. PATENT DOCUMENTS

| | | | |
|---|---|---|---|
| 2,705,111 | 3/1955 | Bruestle | 242/46.2 |
| 3,092,342 | 6/1963 | Jackson | 242/46.2 |
| 3,977,616 | 8/1976 | Owens et al. | 242/46.4 |
| 4,142,690 | 3/1979 | Karle et al. | 242/46.4 |
| 4,223,849 | 9/1980 | Schippers et al. | 242/46.4 |
| 4,232,835 | 11/1980 | Benin | 242/46.4 |
| 4,241,883 | 12/1980 | Benin | 242/46.4 |

*Primary Examiner*—Stanley N. Gilreath
*Attorney, Agent, or Firm*—John H. Shurtleff

[57] ABSTRACT

An improved clamping chuck for bobbins on thread winding machines wherein a bobbin carrier is removably mounted and held on an expandable chucking spindle by means of a plurality of clamping elements distributed in an annular cylindrical inner space formed between the spindle and an outer cylindrical sleeve mantle, each clamping element moving radially outwardly and inwardly of the mantle surface through openings which define the clamping position. The improvement comprises a combination of special clamping elements, each of which has a radially innermost sliding end surface which is inclined with respect to the chuck axis and each of which is paired with a wedge-shaped thrust member with its radially outermost end surface correspondingly inclined with respect to the chuck axis for sliding support in contact with its paired clamping element, such that reciprocal axial movement of the thrust member on the spindle causes the clamping element to move radially between an extended clamping position and a retracted release position. The improvement further includes spring and pneumatic actuated cage means with axially spaced and opposing annular end walls acting as pistons to exert opposite axial forces on each of the thrust members in order to produce the desired reciprocal movement, the associated spring means acting to maintain a radial gripping force by the radially extended clamping element while the chuck is in operation and the associated pneumatic means exerting a force opposing the spring means in order to release each clamping element.

8 Claims, 3 Drawing Figures

CLAMPING CHUCK IN WINDING MACHINES

BACKGROUND OF THE INVENTION

Figure 1:
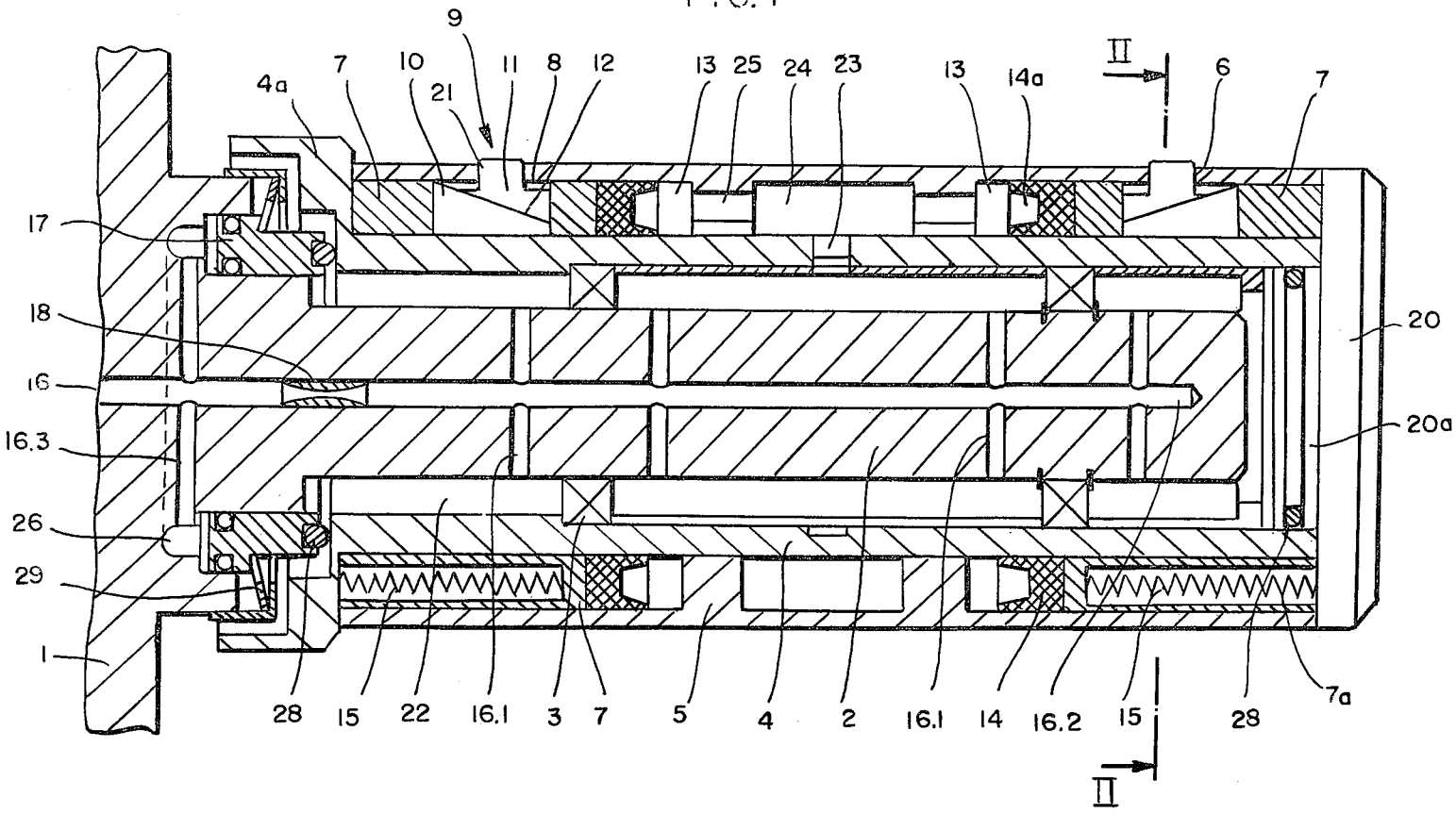

The present invention is directed to a clamping chuck used in textile winding machines, i.e. thread-winding machines which are designed to provide multiple winding units, each having a rotatable chucking spindle arrangement to receive and hold a bobbin carrier such as a cardboard spool tube or the like in order to take up a thread or yarn at relatively high speeds.

More particularly, the present invention is an improvement over the clamping chucks disclosed in U.S. Pat. No. 4,175,712, issued Nov. 27, 1979, and U.S. Pat. No. 4,223,849, issued Sept. 23, 1980, as a continuation-in-part of the earlier issued but copending U.S. Pat. No. 4,175,712. The disclosures of these patents are incorporated herein by reference as fully as if set forth in their entirety, including any material deemed essential to support the claims or to provide an adequate disclosure of the present invention. Both of these patents contain a similar discussion of the prior art, referring to a chuck with clamping elements operating according to the so-called "freewheeling" or coasting principle as disclosed in U.S. Pat. No. 3,815,836.

In some of the known embodiments, the clamping chuck comprises a clamping spindle and a concentric sleeve surrounding the spindle and having openings through which clamping elements emerge radially to grip the inner wall surface of the bobbin carrier. The clamping elements are positioned in an annular space between the clamping spindle and the sleeve, being supported directly on the spindle, and they extend only slightly in the circumferential direction. For example, in FIGS. 4, 5 and 6 of U.S. Pat. No. 4,223,849, these clamping elements have a relatively narrow width while being elongated to permit a pivotal movement when given an axial thrust. The clamping elements at one circumferential position are synchronously moved in an axial direction by an axially movable annular wall which fills the cross-section between clamping spindle and the sleeve. This annular wall is axially moved by a suitable force transmitting means which acts at the same time on all clamping elements to produce the radial movement which is needed for the clamping and the relaxation.

Although these known clamping chucks have desirable design features, including the self-locking of clamping elements at high speeds, they may in some instances not provide sufficient clamping force, e.g. for high-speed winding of large packages and for high acceleration and deceleration.

SUMMARY OF THE INVENTION

It is, therefore, an object of the present invention to provide an improved clamping or gripping effect in a chuck assembly of the freewheeling type while retaining other desirable features of the above-noted prior art, e.g. simplicity in loading and unloading the bobbin sleeves by use of a piston/cylinder arrangement to withdraw the clamping elements into a retracted position. These and other advantages of the present invention will be apparent upon consideration of said prior art taken with the disclosure of this specification.

The improvement of the present invention occurs in a clamping chuck on a thread-winding machine for the reception of a removable bobbin carrier wherein the chuck includes a chucking spindle turnably borne on and extending from the machine frame, a cylindrical mantle sleeve mounted concentrically about said spindle and having an inner diameter greater than an outer diameter of said spindle over a substantial portion of the total length of the chuck so as to define at least one annular cylindrical interspace between the sleeve and the spindle at a selected axial position along the chuck, and a plurality of clamping elements situated within said interspace and radially carried about the spindle at selected sites with openings in the mantle sleeve for the radial passage therethrough of each clamping element. The essential improvement of the invention is directed to the following features:

(1) clamping elements having a free radial movement in an axial plane of the chuck, ideally only a radial movement, each clamping element having
   (a) a radially outermost clamping end, e.g. in the form of an end lug which is guided in its opening in the mantle sleeve between an extended position for gripping the bobbin carrier and a retracted position for releasing the bobbin carrier, and having
   (b) a radially innermost sliding end, e.g. in the form of a cam member, with an inner end surface which is preferably inclined with respect to the chuck axis;
(2) wedge-shaped thrust members, each of which is paired with one of the clamping elements and each having a supporting outer end surface inclined to correspond with and provide a support for the inner end surface of its paired clamping element while being slidably carried on the spindle for movement back and forth in an axial direction as its supported clamping element is moved radially between said extended and retracted positions; and
(3) means to exert an axial force on the thrust member while the chuck is in operation and while the clamping element is guided in its sleeve opening in order to produce a relative movement between the clamping element in radial direction and its wedge-shaped thrust member in axial direction, so as to maintain a radial gripping force exerted by said outermost clamping end on the bobbin carrier.

In one preferred embodiment of the invention, the wedge-shaped thrust members are arranged on a ring member which in turn is slidably supported on the chucking spindle, this ring member preferably having at least one opening, e.g. a narrow gap slot, as viewed about its circumference.

The "axial plane" in which the clamping element and thrust member move has a substantial thickness corresponding to the width of the clamping element and/or thrust member. The wedge-shaped thrust member preferably has substantially the same width as its paired clamping element, i.e. measured transversely of the chuck axis, so that good sliding contact is maintained along the inclined facing surfaces.

The wedge-shaped thrust members are advantageously axially fixed between two annular piston walls which are synchronously movable in axial direction and which fill the interspace between the mantle sleeve and the chucking spindle. A plurality of the paired wedge-shaped thrust members and clamping elements can then be disposed about the circumference of the spindle in a common ring cage formed by the two annular piston walls at either end and by axial segments joining these walls while defining radial openings in the form of elongated slots or cells which receive the paired thrust members and clamping elements. This cage is axially movable by means to exert an axial force, including at least one means to thrust the wedge-shaped members axially in a direction which moves the clamping elements radially outwardly into an extended clamping position. A plurality of compression springs can be advantageously arranged about the cage, e.g. to extend within said axial wall segments, in order to exert the desired axial force for a clamping movement.

It is especially useful to use at least two or more ring cages at a plurality of clamping sites, viewed in the axial direction, depending upon the size and number of bobbin carriers or spool tubes to be mounted on one chucking spindle.

THE DRAWINGS

Figure 2:
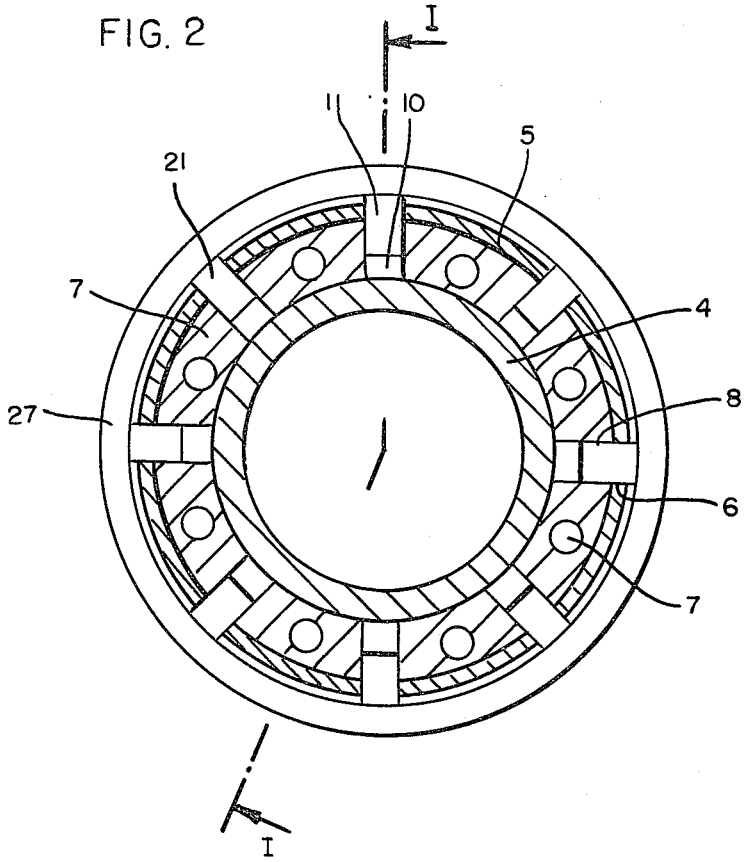
Figure 3:
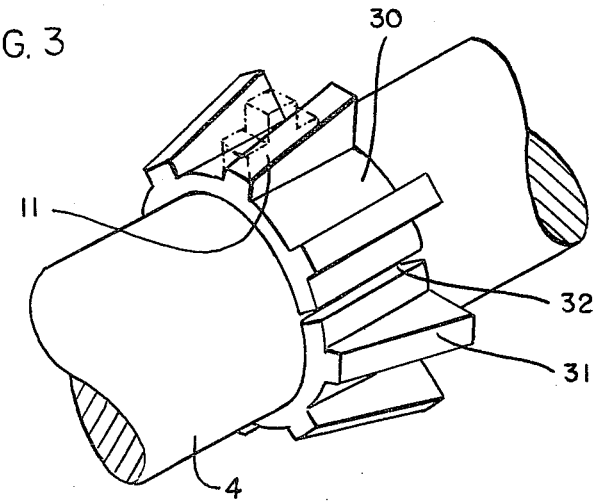

These and other preferred embodiments of the invention are explained in detail in the following description to be read in connection with the accompanying drawings wherein:

FIG. 1 is an axial cross section taken on line I—I of FIG. 2 to illustrate one preferred clamping chuck according to the invention as shown in its released or retracted position;

FIG. 2 is a transverse section taken on line II—II of FIG. 1 through one clamping site, the carrying arm or projecting shaft of the chucking spindle being omitted; and FIG. 3 is a perspective view of a modification of the invention having a ring member which contains a plurality of wedge-shaped thrust members at one clamping site and which is slidably mounted on a chucking spindle, the latter being shown as a simple shaft and without any outer mantle sleeve so that one clamping element can be clearly identified on its paired thrust member.

Referring first to the clamping chuck shown in the axial cross section of FIG. 1, the machine frame 1 of a thread winding unit has a projecting arm or shaft 2 on which there is rotatably mounted by means of ball bearings 3 a clamping spindle 4, which is normally driven by a drive roller or the like running on the circumference of the bobbin or bobbin sleeve (not shown). The mantle sleeve 5 of the clamping chuck is mounted concentrically and at a certain radial distance around the spindle 4. The annular space formed by the spindle 4 and the mantle sleeve 5 is adapted to receive the clamping means 9 for the bobbin sleeves and the actuating means associated therewith for the desired movement of the clamping means. The projecting front end of this annular space is closed by a cap 20, while the opposite end is closed by a collar 4*a* of the clamping mandrel 4.

At two or more axially separated clamping sites, the mantle sleeve 5 has a plurality of openings 6 equally distributed about its circumference, the paired clamping members 9 for clamping one or more bobbin sleeves being arranged to act through these openings 6. The clamping members 9 consist of the wedge-shaped thrust members 10 and the clamping elements 11 which are inserted in the individual slots or cells 8. These slots or cells 8 are formed by a plurality of elongated radial openings or gaps in the piston ring 7, these gaps being smaller in circumferential direction corresponding to their width shown in (FIG. 2) than in their axial length (FIG. 1). The annular piston ring 7 thus acts as a cage with circumferentially spaced, radially extending slots or openings as the cells for receiving the clamping elements 9. Viewed as a transverse section of the opening which forms each cell 8, the shape of the cell may be substantially rectangular with side walls formed by axial segments joining the two annular end walls of the piston. The wedge-shaped member 10 and its clamping element 11 are shown in FIG. 2 without cross-sectional hatching so that they will stand out from the other parts of the chuck. The opening 6 corresponds in size and shape to the transverse section of the clamping end or lug 21 of the clamping element 11, i.e. a section transverse to its direction of radial movement. The clamping end 21 thus fits into and practically fills the opening 6 such that the clamping element 11 is easily moved in a radial direction and, at the same time, is safely guided by the side walls of the opening 6.

The outermost end surfaces of the clamping lugs 21, which rest against and grip the inner circumference of the bobbin sleeves have been roughened and preferably milled so as to give them a better gripping traction, i.e. profiled to yield a surface of ridges and grooves which may have a corrugated appearance. The angle of this milled surface, i.e. the angle of the ridges and grooves, to the longitudinal axis of the chucking spindle is preferably about 45 degrees. On the other hand, the ridges and grooves may also extend parallel to the chuck axis or at an angle of 90° thereto, or else a cross-hatching pattern may be adopted. It is especially advantageous to choose an angle of about 45° because the bobbin sleeve is then securely and safely held even when considerable forces act on it in axial and/or circumferential direction. Such a profiled gripping surface does not require a detailed showing since it represents an easily understood modification in the outermost end surface of the metal lugs 21.

As shown in FIG. 1, the thrust member 10 and the clamping element 11 have inclined wedging surfaces facing each other on the line 12. During the axial movements of the thrust members 10, these wedging surfaces slide on each other in such a manner that the clamping elements 11 are pushed or displaced radially first outwardly and then radially inwardly of the mantel sleeve 5, i.e. back and forth into the extended clamping position and then into the retracted non-clamping position, respectively.

The innermost sliding surfaces of the thrust members 10 facing the chucking spindle 4 always rest against and are supported by the outer circumference of the spindle 4 (FIGS. 1 and 2). Because these members 10 are connected or held in place at either end by the annular end walls of the cage 7, it will be seen that the entire cage assembly moves axially back and forth as a single unit while the clamping elements 10 move radially in and out of sleeve 5.

The clamping elements 11 have radially recessed shoulders on either side of the end lug 21, extending in an axial direction such that they wll rest against the inner circumference of the mantle sleeve 5 of the chucking spindle, thus preventing the members 11 from leaving the openings 6 or being ejected out of them at high speeds. These shoulders can also be positioned so as to give the lugs 21 a maximum radial extension, even under centrifugal forces at high speeds, thereby preventing any serious damage to the bobbin carrier. Where the winding machine requires the chucking spindle to be run at very high speeds, a damaged bobbin sleeve sometimes bursts apart explosively. The retaining shoulders on the clamping elements 11 fully prevent them from being ejected in the event that an empty bobbin sleeve does explode while also serving to prevent damage to the bobbin sleeve in the first place.

FIG. 1 shows the paired clamping members 9 in the released position, which is the normal position when the winding unit has been taken out of operation, e.g. during the exchange of a full bobbin for an empty spool tube or carrier.

Axial bores 7*a* are equally distributed about the circumference of ring 7 between the cells 8, with a single compression spring 15 being mounted in each bore. One end of the spring 15 lies against the inner end surface of the axial bore 7*a*, while the other end is bounded by the collar 4*a* of the spindle 4 or by the cap 20, respectively. The inner end surface of the ring 7 turned away from the spring 15 has a sealing ring or gasket 14, which is shaped as a piston surface 14*a* having a large area which can be acted upon by a pressure means, preferably by air under pressure, in the space constructed as a cylinder space 13.

As shown in FIG. 1, the two rings 7, 14 acting as a piston are moved against the force of spring 15 into the released position of the chuck by means of pressurized air, the spring 15 thus being compressed. The pressurized air is supplied to the cylinder spaces 13 through air channels 16 and 16.1, ring gap 22, radial bore 23, annular space 24, and the axial bores 25. The piston/cylinder operation is substantially the same as that disclosed in FIG. 5 of U.S. Pat. No. 4,223,849.

At the beginning of the clamp release or retraction, a choke 18 positioned in the supply channel 16.2 behind the air channel 16.3 ensures that the pressurized air becomes effective first in a cylinder space 26 by acting upon an annular piston 17 in such a way that it moves axially counter to the force of a spring 29, thus causing a sealing O-ring 28 inserted in its annular front surface to abut against the facing surface of the spindle 4, thereby closing off the annular gap 22 in the direction of the machine side to prevent any release of air from the pressurized system. A similar O-ring 28 seals off the front end of the annular gap 22, e.g. as it is pressed by the inner plug 20*a* of cap 20. It should be pointed out that during the released or retracted position of the clamping means, there is no relative movement between the chucking spindle 4 and the machine frame 1. Thus, the supply channel 16 is turned on to introduce air under pressure only when the chuck is out of operation.

The radial air channels 16.1 are arranged in front of and behind each of the bearing bodies 3 in order to prevent the lubricant in the bearings 3 from being blown out by a surge in the pressure from one side only. This pressure equalization on the bearings is desirable even when the chuck is at a standstill to prevent a one-sided flow of lubricant therethrough during pressure changes.

For clamping a bobbin sleeve 27 (FIG. 2) onto the chucking assembly, air pressure is released from the cylinder spaces 13 by venting air from the system, so that ring 7 is axially displaced by the springs 15. The wedge-shaped thrust members 10 axially slide along the bottom inclined surface of the clamping elements 11 which are held in their fixed axial position by the openings 6. The resulting relative movement between the wedge surfaces 12 of the thrust members 10 and the clamping elements causes a radial movement of the clamping lugs 11 outwardly. Thus the bobbin sleeve 27 illustrated in FIG. 2 is internally gripped by the clamping or gripping ends 21 of the elements 11. At the same time, pressure is released from the cylinder space 26, and spring 29 forces the piston 17 back into its rest position.

For releasing or unclamping the chuck, the relative movement between the thrust members 10 and clamping elements 11 takes place in the opposite direction, i.e. the piston 7, 14 is actuated with pressurized air supplied through the above described channel system, so as to move ring 7 against the force of the spring 15. By this movement, the clamping elements 11 are released from their outward, i.e. clamping position and are now radially movable. Therefore, the bobbin sleeve may be removed from and an empty sleeve may be inserted on the chuck.

It should be pointed out that the chucking assembly and, correspondingly, the carrying arm 2 may be considerably longer, and that the chucking spindle may be equipped with many more clamping places in its axial extension than are illustrated in the drawing. This extension makes it possible to receive on one clamping spindle either a single, extremely long bobbin or several, e.g. up to eight, bobbins of normal length. The chucking spindle of the present invention is thus especially adapted to receive a large number of short bobbins.

Bobbin sleeves are often manufactured from a material such as cardboard which does not lend itself to the observance of small tolerances, i.e. it is practically impossible to avoid large variations of the inner diameter of cardboard sleeves simply due to the manner in which they are inexpensively manufactured. As is well known, at least two clamping sites with several clamping elements distributed about the circumference of each site are necessary in order to achieve a safe clamping of each bobbin sleeve in the axial direction. So as to compensate for large tolerances in the inner diameter of these sleeves over their axial lengths, the clamping elements of each clamping site must be able to project from the mantle sleeve of the chuck at a radial distance which differs from one site to the next. The present invention offers a chucking assembly where it is possible to provide each clamping site with an annular piston wall which is moved axially by a suitable force transmitting means and which in itself moves the wedge-shaped thrust members in an axial direction, while each annular piston wall is axially movable independently of the other annular piston walls at other clamping sites on the same chucking spindle. Due to this design, the clamping elements of the various clamping sites can be separately moved radially out of the mantle sleeve of the chuck, thereby fully compensating for large variations in the tolerances of the inner diameter of the bobbin sleeve.

Another advantage of the present invention is that the clamping elements are not mounted on strips, cleats, moldings or similar elements, as frequently done in prior chucks, but are single bodies with only a very slight axial and circumferential extension. This makes is possible to distribute a relatively large number of clamping elements over the length and the circumference of the clamping chuck having a relatively small diameter, i.e. without unfavorably reducing the supporting cross section of the chuck.

A special advantage of the chuck of the present invention resides in the fact that during operation the clamping means consisting of the inner wedge members and outer clamping elements can be mounted and guided without play between the bobbin and the clamping spindle. It should be further noted that the clamping means as members or elements which are fitted in this manner are not subject to the usual fretting or galling, i.e. the wear caused by irregular frictional contact. Thus, at high speeds accompanied by the risk of strong vibrations, the axial thrust members of the present invention are preferably designed as single wedge-shaped bodies having a width which preferably corresponds to the width of the clamping elements supported thereon. With this design, one need not provide a clearance fit which is otherwise essential between a clamping ring and the clamping spindle on which the ring is mounted. A fretting or frictional wear of the clamping chuck is usually caused by high vibrations inherent in all winding machines. But when the wedge-shaped bodies are used as thrust members designed according to the present invention, a force fit is ensured during the operation of the chuck, i.e. a positive force fit between the thrust members 10 and the spindle 4 as well as between these thrust members and the clamping elements 11 along their inclined surfaces which are in sliding contact and which are preferably of equal width.

Even at high speeds where centrifugal forces act strongly on the clamping elements 11 to urge them radially outwardly of the sleeve 5 with a force which may surpass the force transmitted by the axially compressed springs 15, the thrust members 10 will always be maintained in close sliding contact with the clamping elements 11 due to the resilient urging of the springs 15 against the annular piston walls 7 and thereby against the wedged pair of clamping means. When the chuck is braked to reduce the speed, e.g. at the end of the winding operation, the thrust members 10 continue to exert a positive action to maintain the desired wedge or force fit againt clamping elements 11, thereby preventing undue wear caused by vibrations. And as the chuck slows down to the point where the centrifugal forces on the clamping elements 11 are too small to have any effect, the thrust members 10 continue to act in a way which will maintain the desired close fit and secure clamping of the bobbin sleeve.

Moreover, it is possible to produce much greater radial clamping forces with only relatively low axial thrust forces by selecting a relatively low angle of inclination for the sliding wedge surfaces. This angle of inclination, taken with reference to the chuck axis, is preferably less than 30° so as to provide a force ratio of at least about 2:1 and preferably at least about 2.5:1.

The axial thrust means as illustrated in FIG. 3 comprises a thin-walled ring 30 which has cams 31 equally distributed over its circumference and inclined in an axial direction, i.e. as individual wedging members on which the clamping elements 11 slide (one being indicated by phantom lines). The ring 30 has a slot opening 32 which, for the purpose of gripping a bobbin sleeve, permits the ring 30 to spring to a certain extent, until it is in close supporting and sliding contact with the chucking spindle 4.

The ring 30 may also have several slots distributed over the entire circumference. Also a slotted or an unslotted ring may be used which does not have any cams 31, but instead presents a conical and closed circumference. Such variations in the axial thrust means are possible since it is always part of the ring cage 7 and moves axially with the two end walls of this ring cage.

In all cases, the specific paired clamping means of the present invention, i.e. the axially sliding inner wedge member and its radially sliding outer clamping element which face each other on a common inclined plane help to prevent wear because of their large contact areas. And even when the chuck is placed into operation at lower running speeds, the bobbin sleeve is firmly held with very little movement or play in the clamping assembly until the chuck is completely stopped and the air pressure means is used to disengage the chuck by an axial thrust opposite to the normal axial thrust of the springs 15.

The invention is hereby claimed as follows:

1. In a clamping chuck on a thread-winding machine for the reception of a removable bobbin carrier wherein said chuck includes a chucking spindle turnably borne on and extending from the machine frame, a cylindrical mantle sleeve mounted concentrically about said spindle and having an inner diameter greater than an outer diameter of said spindle over a substantial portion of the total length of the chuck so as to define at least one annular cylindrical interspace between said sleeve and said spindle at a selected axial position along the chuck, and clamping means situated within said interspace and being radially movable through openings in said mantle sleeve, the improvement which comprises:

a plurality of clamping elements arranged in said interspace between said spindle and said mantle sleeve for free radial movement in an axial plane of the chuck, each clamping element having a radially outermost clamping end which is radially movable of its sleeve opening and guided by said opening between an extended position for gripping the bobbin carrier and a retracted position for releasing the bobbin carrier and having a radially innermost sliding end surface which is inclined with respect to the chuck axis;

a plurality of wedge-shaped thrust members, each of said thrust members being paired with a clamping element and being defined by a radially outermost end surface inclined with respect to the chuck axis to provide a sliding support in contact with the correspondingly inclined inner end surface of its paired clamping element, and each wedge-shape thrust member being slidably carried on the spindle for movement back and forth in an axial direction as its supported clamping element is moved radially between said extended position and said retracted position;

spring and pneumatic actuated cage means having axially spaced and opposing annular end walls which act as pistons to exert opposite axial forces on each of said thrust members while the clamping element is guided in its sleeve opening in radial direction in order to cause a relative movement between each clamping element and the axially inclined surface of its paired wedge-shaped thrust member;

spring means to actuate said cage means while the chuck is in operation in order to maintain a radial gripping force exerted by said outermost clamping end of said clamping element on said bobbin carrier; and pneumatic means cooperating with said cage means to exert a pneumatic force opposing said spring actuation of said cage means in order to release each clamping element.

2. A clamping chuck as claimed in claim 1 wherein said wedge-shaped thrust members are arranged on a ring member slidably supported on said chucking spindle.

3. A clamping chuck as claimed in claim 2 wherein said ring member has at least one opening as viewed about its circumference.

4. A clamping chuck as claimed in claim 1 wherein each wedge-shaped thrust member has substantially the same width as its paired clamping element, measured transversely of the chuck axis, and is axially fixed between said two piston end walls which are synchronously movable in axial direction and which fill the interspace between said sleeve and said spindle.

5. A clamping chuck as claimed in claim 4 wherein said plurality of said paired wedge-shaped thrust members and claimping elements are disposed about the circumference of the spindle in said cage means formed by the two annular piston end walls and by axial segments joining said walls while defining radial openings which receive the paired thrust members and clamping elements, said cage being axially movable by said spring means and said pneumatic means.

6. A clamping chuck as claimed in claim 5 having a plurality of clamping sites, viewed in the axial direction of the chucking spindle, each clamping site having its own cage means which is axially movable by said spring means and said pneumatic means independently of the cage means of the other clamping sites.

7. A clamping chuck as claimed in each of claims 1 to 6 wherein the clamping ends of the clamping elements are profiled to securely engage the inner surface of a bobbin sleeve being gripped thereby.

8. A clamping chuck as claimed in each of claims 1 to 6 wherein the clamping elements have shoulders positioned radially inwardly of the clamping ends, said shoulders extending axially within said sleeve for a distance longer than the sleeve openings, thereby retaining the elements on the sleeve.

* * * * *